United States Patent [19]

Lloyd

[11] 4,364,192

[45] Dec. 21, 1982

[54] MINIMAL PARTS, QUICK PICTURE FRAME

[76] Inventor: Roland W. Lloyd, 4202 Phinney Ave. N., Seattle, Wash. 98103

[21] Appl. No.: 182,008

[22] Filed: Aug. 28, 1980

Related U.S. Application Data

[63] Continuation of Ser. No. 60,783, Jul. 25, 1979, abandoned.

[51] Int. Cl.[3] ..... G09F 1/12

[52] U.S. Cl. ..... 40/155

[58] Field of Search ..... 40/152, 152.1, 155, 40/156, 209; 248/473, 488, 490; 50/476

[56] References Cited

U.S. PATENT DOCUMENTS

| | | | |
|---|---|---|---|
| 1,481,120 | 1/1924 | Brombosz | 40/155 |
| 2,285,176 | 6/1942 | Taylor | 40/152.1 X |
| 2,395,369 | 2/1946 | Burr | 40/154 |
| 2,490,058 | 12/1949 | Jablon | 40/152 |
| 2,950,556 | 10/1960 | Larios | 40/154 |
| 2,993,290 | 7/1961 | Bell et al. | 40/152 |
| 3,060,606 | 10/1962 | Peach | 40/154 |
| 3,200,526 | 8/1965 | Munn | 40/152 |
| 3,384,987 | 5/1968 | Prechtl | 40/152.1 |
| 3,570,160 | 3/1971 | Spertus | 40/152 |
| 3,711,978 | 1/1973 | Conrad | 40/152 |
| 3,787,922 | 1/1974 | Foy et al. | 248/473 |
| 3,867,774 | 2/1975 | Kise | 40/155 |
| 4,055,319 | 10/1977 | Pendock | 248/488 |

FOREIGN PATENT DOCUMENTS

| | | | |
|---|---|---|---|
| 2255378 | 5/1974 | Fed. Rep. of Germany | 40/152 |

OTHER PUBLICATIONS

Advertisement for Silvatrim "Slip-On" Frame Mouldings by Glass Laboratories, Inc. of 863 65th St., Brooklyn NY 11220.

*Primary Examiner*—Paul J. Hirsch
*Assistant Examiner*—Wenceslao J. Contreras
*Attorney, Agent, or Firm*—Gregory W. Moravan; Roy E. Mattern, Jr.

[57] ABSTRACT

A minimal parts, quick picture frame, for framing paintings, pictures, photographs, graphics, weavings, etc., for viewing, centers on the use of at least four framing pieces, i.e. two sets of opposite pairs, all made by cutting them from a continuous type plastic extrusion, formed to frictionally and resiliently grip the other components of the picture mounting composite. No additional hardware or fasteners are used to hold the pieces of the frame together, nor are tools needed, following the cutting of the extrusion. Selected lengths of these generally mitered cornered framing pieces all grip the edges of a picture mounting composite, comprising the overall assembly of a picture, painting, etc. and other related mounting material, such as backing boards, glass or clear plastic covering, etc., with a continuous resilient spring like gripping action, thereby providing a snug, moisture resistant seal, while automatically adjusting to varying thickness of the picture mounting composite, and while self-aligning the framing members.

1 Claim, 5 Drawing Figures

MINIMAL PARTS, QUICK PICTURE FRAME

This is a continuation of application Ser. No. 060,783, filed July 25, 1979 now abandoned.

BACKGROUND OF THE INVENTION

The framing of paintings, photographs, weavings, pictures or graphic displays has traditionally been a time consuming and expensive undertaking, often tending to economically prohibit the framing of any of them, except those of substantial monetary or sentimental value. In contrast, this minimal parts quick picture frame of this invention represents a low cost, minimal parts frame requiring only seconds to assemble and disassemble, without fasteners and without tools, while simultaneously offering enhanced moisture and dust protection, an attractive and aligned appearance, and an adaptability to any size picture upon selecting various length framing pieces of the extrusion.

SUMMARY OF THE INVENTION

A minimal parts, quick picture frame for framing paintings, pictures, photographs, graphics, weavings, etc. uses at least four selected length framing pieces, in two sets of two each, cut by the manufacturer, shopkeeper, or user, from a so-called continuous plastic extrusion, using a mitered cut. Each frame piece is frictionally slipped over an edge of a picture mounting composite comprised of the picture, etc., backing board, glass, transparent plastic etc., and the mitered corners of the frame pieces are aligned and abutted to form a handsome, protective overall picture frame, without using fasteners, hardware, or tools, or other manipulations. The spring like frictional gripping action receives varying thicknesses of picture mounting composites and firmly secures and aligns the frame members while forming a moisture and dust resistant seal. Disassembly is readily accomplished by merely pulling the frictionally held frame members away from the edge of the picture mounting composite, since no corner fasteners are needed or wanted, thereby permitting rapid changing of the frame contents. This minimal parts, quick frame system is also ideal for framing mirrors and other objects requiring a low cost, easily installed border.

PREFERRED EMBODIMENT OF THE INVENTION

A preferred embodiment of the minimal parts quick picture frame is illustrated in the accompanying drawings, wherein.

DESCRIPTION OF THE PREFERRED EMBODIMENT

Figure 1:
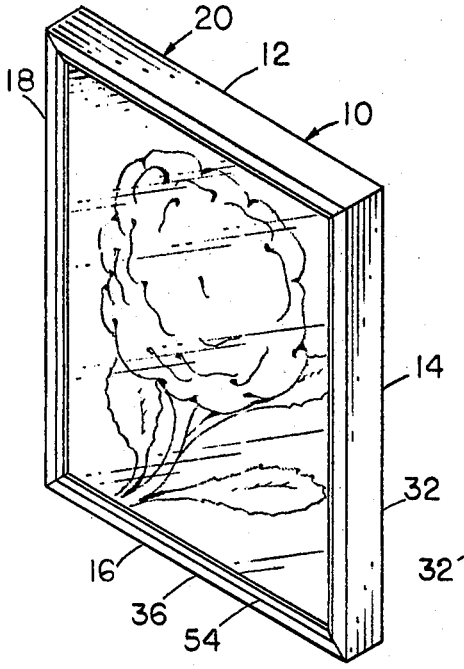
FIG. 1 is a front perspective view of the assembled frame showing four frame pieces secured to a picture mounting composite with their mitered ends aligned and abutted to form a complete rectangular frame.
Figure 2:
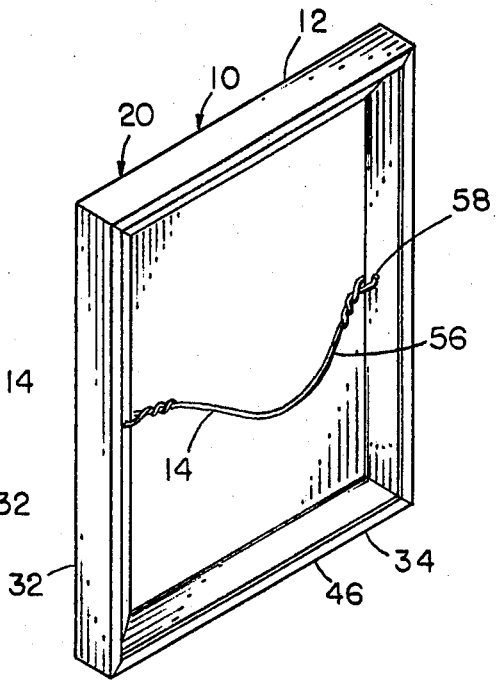
FIG. 2 is a rear perspective view of the assembled frame showing the four framing pieces secured to the picture mounting composite, with a hanging wire attached to holes in respective framing pieces.

A minimal parts quick picture frame 10 for framing paintings, pictures, photographs, graphics, weavings, etc. in the illustrated embodiment, has four frame pieces 12, 14, 16, 18, mitered cut 19 from a continuous extrusion 20 of a rigid yet resilient polyvinyl chloride material. Each frame piece is frictionally, snugly, and resiliently fitted around the edges of a picture mounting composite 22, comprising the picture 24 to be framed and related mounting material such as a glass cover 26, backing board, 28 and/or matting, not shown, etc. No additional fasteners or hardware are needed to assemble a complete frame, following the cutting of the extrusion 20. Generally the customer buys the pre-cut frame, so no tools are needed during assembly.

Figure 3:
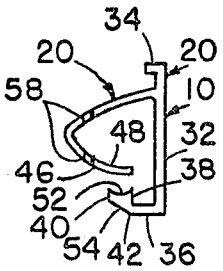
FIG. 3 is a cross-sectional view of a frame piece, indicating the shape of the plastic extrusion from which it is cut.
Figure 4:
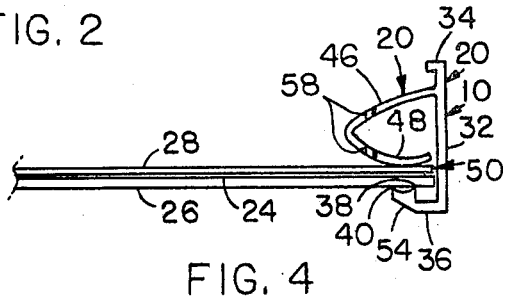
FIG. 4 is a cross-sectional view of a frame piece showing a picture, glass and backing board mounting composite inserted and gripped by the spring action of the resilient plastic extrusion frame piece.
Figure 5:
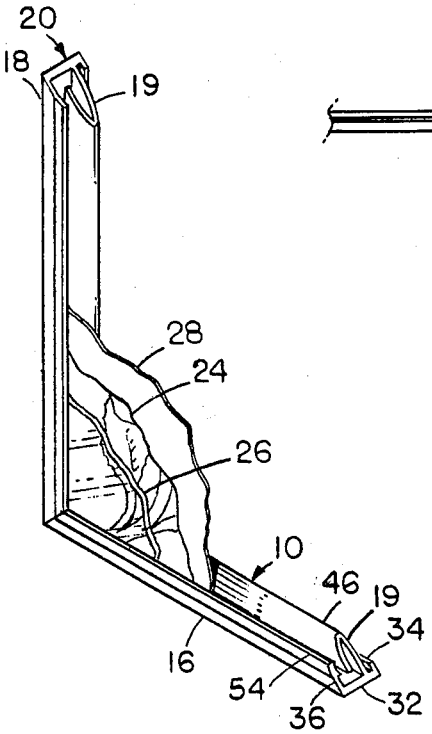
FIG. 5 is a front perspective showing two frame pieces joined to a cutaway of the picture mounting composite and also illustrating the mitered corners of the frame pieces.

The extrusion 20 from which each frame piece is cut, has, as shown in FIGS. 3 and 4, the all integrally extruded portions of a side frame portion 32, terminating at the rear of the resulting frame in a reinforcing stiffening flange 34, and terminating at the front in a beveled reinforcing stiffening flange 36 which on its exterior is subject to various eye pleasing shapes in bordering the picture, and which on its interior is especially formed as a two rib 38, 40, alignment abutment portion 42 to contact the glass 26 near its edge. Integrally extending from the side frame portion 32, toward the center of the back of the picture frame is a cantilevered reverse fold like flexible portion 46, having a free end portion 48 spaced oppositely of the ribs 38, 40 on the alignment abutment portion 42 of the front reinforcing stiffening flange 36. The space between this flexible free end portion 48 and the ribbed abutment portion 42 forms an adjustment channel like opening, into which combined edges 50 of the picture mounting composite members of various thicknesses are inserted and thereafter are snugly, frictionally, and firmly gripped. The reverse fold like flexible portion 46 is modified in thickness and curved to obtain a spring-like resiliency, flexing to provide both sufficient pressure for gripping and sufficient entry space for varying thicknesses of the picture mounting composite 22.

After their attachment to the picture mounting composite 22, frame pieces 12, 14, 16 and 18 are hand aligned in the respective longitudinal directions with the picture mounting composite edges 50, to which they are frictionally adjusted until all the mitered corners are square and flush. No fastening or gluing is required at these corners as each frame member is frictionally retained in place.

Alignment in the cross-sectional plane of frame members is accomplished readily and essentially automatically by the action and constructions of the reverse fold like flexible portion 46 and the ribbed abutment portion 42. As viewed in the cross-section, shown in FIG. 4, the rigid ribbed abutment and alignment portion 42 contacts the surface of picture mounting composite 22 at two distinct lineal locations, due to its concave shape 52 forming the two ribs 38 and 40. The reverse fold like flexible portion 46 in contrast, contacts the surface of picture mounting composite 22 at a single lineal location via the flexible free end portion 48. These point contacts appearing in this cross-sectional view of FIG. 4, actually form continuous line contacts with the surface of the picture mounting composite 22 in a longitudinal view, there being two parallel contact lines on the front surface of the picture mounting composite 22, and one contact line on the rear surface. When pressure is applied to the rear surface of picture mounting composite 22 through the flexible free end portion 48, the front surface of picture mounting composite 22 also becomes firmly abutted by and against the two ribs 38, 40 of the rigid abutment and alignment portion 42, thereby readily and essentially automatically aligning and stabilizing the frame sections 12, 14, 16 and 18, as viewed in FIG. 4 in the cross-sectional plane. In this preferred embodiment, the angle determined by the two rib contact of rigid abutment and alignment portion 42 is such, that the side frame portion 32 is maintained essentially perpendicular to the combined edges 50 of the components of the picture mounting composite 22, as illustrated in FIG. 4.

The single line contact of the flexible free end portion 48 of the reverse fold like flexible portion 46 adapts to varying overall thicknesses of the picture mounting composite 22 without affecting the alignment or stability of the frame sections 12, 14, 16 or 18, because this alignment is further uniquely determined by the two lines contact of rigid ribbed alignment and abutment portion 42, and also the single line contact is maintained as the flexible free end portion 48 is moved toward or away from the ribs 38, 40.

The continuous contact pressure due to the frictional gripping action existing between the flexible free end portion 48 and the ribs 38, 40 with the respective back and front surfaces of picture mounting composite 22, forms a positive continuous moisture and dust proof seal on both sides of the picture mounting composite 22. The front reinforcing stiffening flange 36 has a beveled front surface 54 shaped to form an aesthetically pleasing boundary to the picture mounting composite 22, i.e. the picture frame contents. In other extrusions changes to this boundary portion result in other overall design appearances. The rear reinforcing stiffener flange 34 increases the longitudinal stiffness of each respective frame pieces 12, 14, 16, 18, while often providing a convenient means of hanging the frame and contents of smaller pictures by hooking the lip of the flange 34 over a nail, hook or screw secured to a wall. This picture frame and its contents are also suspended from a nail, hook or screw secured to a wall by attaching a wire or cord 56 between attachment holes 58, drilled at the same time, provided on opposite frame pieces, top, bottom and/or side; for this purpose, as the wire or cord is thereafter placed over the nail, hook or screw, not shown.

The very convenient and quick changing of the contents of this minimal parts quick picture frame is accomplished by pulling the frictionally held frame pieces 12, 14, 16, and 18 outwardly away from the combined edges of the picture mounting composite 22, then changing the picture, and thereafter pressing the frame pieces back over the combined edges of the new picture mounting composite 22. Again, no tools are needed and no fasteners are used.

I claim:

1. A frame adapted to frame an object which is at least generally planar, wherein said frame comprises a plurality of frame pieces, each frame piece being an elongated extrusion made from plastic which includes:

a. a side wall;

b. a relatively rigid flange having a base integrally formed with said side wall, wherein said relatively rigid flange extends outwardly at generally right angles with respect to said side wall and terminates in a free end which includes a pair of elongated parallel ribs; and c. a flexible, resilient, gripping flange having a base integrally formed with said side wall, wherein the bases of said relatively rigid flange and said resilient gripping flange extends outwardly from said side wall for a substantial distance, and then reverses direction and extends back towards said side wall and terminates in a free end which is located generally opposite from the free end of said relatively rigid flange; and wherein each said frame piece is adapted to be secured to a respective edge of said object by gripping its said respective edge between the free ends of its said relatively rigid flange and resilient gripping flange; and wherein the pair of elongated parallel ribs of the relatively rigid flange and the free end of said resilient flange are arranged, sized and positioned such that when each said frame piece is secured to its respective edge portion of said object, the area of contact of the free end of said resilient flange with said object lies opposite from and between said ribs on said relatively rigid flange, to enable each said frame piece to better grip its respective edge portion of said object.

* * * * *